US006315336B1

(12) United States Patent
Swartzell

(10) Patent No.: US 6,315,336 B1
(45) Date of Patent: Nov. 13, 2001

(54) MOTORIZED SELF-CLEANING OVEN LATCH

(75) Inventor: Scott D. Swartzell, Chester, CT (US)

(73) Assignee: Summit Manufacturing, Inc., Newington, CT (US)

( * ) Notice: Subject to any disclaimer, the term of this patent is extended or adjusted under 35 U.S.C. 154(b) by 39 days.

(21) Appl. No.: 09/580,696

(22) Filed: May 30, 2000

(51) Int. Cl.[7] ..... E05C 3/06
(52) U.S. Cl. ..... 292/201; 292/DIG. 69
(58) Field of Search ..... 292/DIG. 69, DIG. 60, 292/110, 334, 201, 341.16; 49/280

(56) References Cited

U.S. PATENT DOCUMENTS

| | | | | |
|---|---|---|---|---|
| 3,750,643 | * | 8/1973 | Fowler et al. | 126/197 |
| 3,815,942 | * | 6/1974 | White | 292/113 |
| 3,881,462 | | 5/1975 | Barnett . | |
| 4,013,312 | | 3/1977 | DeWeese . | |
| 4,163,443 | * | 8/1979 | Peterson | 126/197 |
| 4,554,907 | | 11/1985 | Overley et al. . | |
| 4,838,586 | | 6/1989 | Henne . | |
| 4,927,996 | * | 5/1990 | Genbauffe et al. | 219/413 |
| 5,012,794 | * | 5/1991 | Faurel | 126/197 |
| 5,029,910 | * | 7/1991 | Genbauffe et al. | 292/110 |
| 5,220,153 | * | 6/1993 | Malone et al. | 219/413 |
| 5,419,305 | | 5/1995 | Hanley . | |
| 5,440,103 | * | 8/1995 | Martin | 219/413 |
| 5,477,030 | * | 12/1995 | Buckshaw et al. | 219/413 |
| 5,493,099 | * | 2/1996 | McWilliams, III | 219/413 |
| 6,079,756 | * | 6/2000 | Phillips | 292/198 |
| 6,168,113 | * | 1/2001 | Hann et al. | 244/129.4 |

* cited by examiner

*Primary Examiner*—Robert J. Oberleitner
*Assistant Examiner*—Benjamin A Pezzlo
(74) *Attorney, Agent, or Firm*—DeLio & Peterson, LLC

(57) ABSTRACT

An oven latch includes a base, a pivot, and a latch arm with a slot that engages the pivot and allows the latch arm to slide and rotate relative to the pivot. A motor mounted on the base rotates a cam, and a rod connected between the cam and the latch arm closes the latch when the cam turns, thereby pivoting the latch arm closed to engage the oven door and sliding the latch arm inwards along the latch arm slot to pull in the door. The pivoting and sliding motion of the latch arm is controlled by a guide slot formed in the base having a normal guide portion and a repair guide portion. During normal operation, an end of the rod moves along the normal guide portion of the guide slot. If the motor fails, the end of the rod may be manipulated into the repair guide portion of the guide slot to open the latch when the motor and cam are in the closed position.

22 Claims, 3 Drawing Sheets

MOTORIZED SELF-CLEANING OVEN LATCH

BACKGROUND OF THE INVENTION

1. Field of the Invention

The present invention relates to oven latches used to latch an oven door closed during a self-cleaning cycle. More specifically, the present invention relates to motorized self-cleaning oven latches used with electronic oven controls.

2. Description of Related Art

Self-cleaning ovens reach a very high temperature during the cleaning operation. To prevent injury, safety standards require the door to be automatically latched when the oven is above a safe operating temperature to prevent the door from being opened. In some ovens, the automatic latching is achieved by moving a locking element with a bimetallic coil responsive to the temperature reached by an oven during the self-cleaning cycle. However, many modern ovens use digital electronic controls and in these designs the latching is preferably accomplished with a motorized latch that operates directly under electronic control.

One problem with conventional motorized latches is that the motor may fail, leaving the door locked even after the temperature within the oven has dropped to a safe level. Failure of the motor when the latch is in the locked position leaves the oven unusable, even when it is not in the self-cleaning cycle. It is essential to provide some means of allowing a service person to open the oven door in the event the motor fails.

Another problem with prior art latches is that the switches or motor may fail when exposed to excessive heat. A further problem is the number of components and the time required to assemble prior art self-cleaning oven latches. Still another problem is that prior art oven latches often require a separate door switch to signal the oven control when the door is closed so that the motorized latch may be operated.

Bearing in mind the problems and deficiencies of the prior art, it is therefore an object of the present invention to provide a motorized oven latch that allows a service person to open the oven door in the event the motor fails.

It is another object of the present invention to provide a motorized oven latch having a simple design with a minimum number of parts to decrease manufacturing cost and assembly time.

A further object of the invention is to provide a motorized oven latch design with common components that may be used in different configurations for use with different ovens having varying door designs.

Yet another object of the invention is to provide a motorized oven latch design with an integrated door sensing switch to signal when the door is closed.

Still other objects and advantages of the invention will in part be obvious and will in part be apparent from the specification.

SUMMARY OF THE INVENTION

The above and other objects, which will be apparent to those skilled in art, are achieved in the present invention which is directed to an oven latch having a base, a pivot mounted on the base, a latch arm, a motor, a cam rotatably driven by the motor from a first position to a second position, and a rod connected to the cam and the latch arm. The latch arm has a slot formed in it, and the slot engages the pivot so that the latch arm is free to both slide and rotate relative to the pivot. The rod slides and rotates the latch arm from an open position to a closed position as the cam rotates from the first position to the second position.

In the preferred design the oven latch also includes a guide slot, preferably formed approximately as a "J." One end of the latch arm is guided by the guide slot to control sliding and rotating motion of the latch arm relative to the pivot. In the most highly preferred embodiment of the invention, the guide slot has a normal guide portion and a repair guide portion.

The latch arm is guided by the normal guide portion of the guide slot during normal operation as the latch arm is moved by the cam and rod between the open position with the cam in the first position and the closed position with the cam in the second position. The latch arm is guided by the repair guide portion when it is necessary to repair the oven latch. The repair guide portion permits the oven latch to be opened when the cam is in the second position.

In one embodiment of the invention, the repair guide portion of the guide slot is separated from the normal guide portion of the guide slot by a mechanical obstruction, preferably a bendable mechanical obstruction, that limits motion of the end of the latch arm to motion along the normal guide portion of the guide slot during normal operation.

In another embodiment of the invention, the repair guide portion of the guide slot is not separated from the normal guide portion of the guide slot. Instead, a spring is connected to the latch arm or the rod to keep the end of the latch arm guided by the normal guide portion of the guide slot during normal operation of the oven latch. The spring allows the end of the latch arm and the rod to be manipulated and guided by the repair guide portion of the guide slot during repair of the oven latch to permit the oven latch to be opened when the cam is in the second position.

The spring may be combined with a guide slot having a widened portion; and an oven door sensing switch having an actuator extending partially across the widened portion of the guide slot to detect the absence of an oven door.

One or more switches may also be installed and operated by the cam as the cam rotates to signal the status of the latch to the oven control.

In yet another embodiment of the oven latch, the base includes first and second halves which may be part of a single extended piece, or which may be physically separate. The first half of the base is mountable near the door of the oven to be latched and the latch arm and the pivot are mounted on that half. The second half of the base has the motor and cam mounted thereon and is mountable in a remote location. The rod is lengthened as necessary to extend between the first and second halves of the base.

BRIEF DESCRIPTION OF THE DRAWINGS

The features of the invention believed to be novel and the elements characteristic of the invention are set forth with particularity in the appended claims. The figures are for illustration purposes only and are not drawn to scale. the invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–5 of the drawings in which like numerals refer to like features of the invention.

Figure 1:
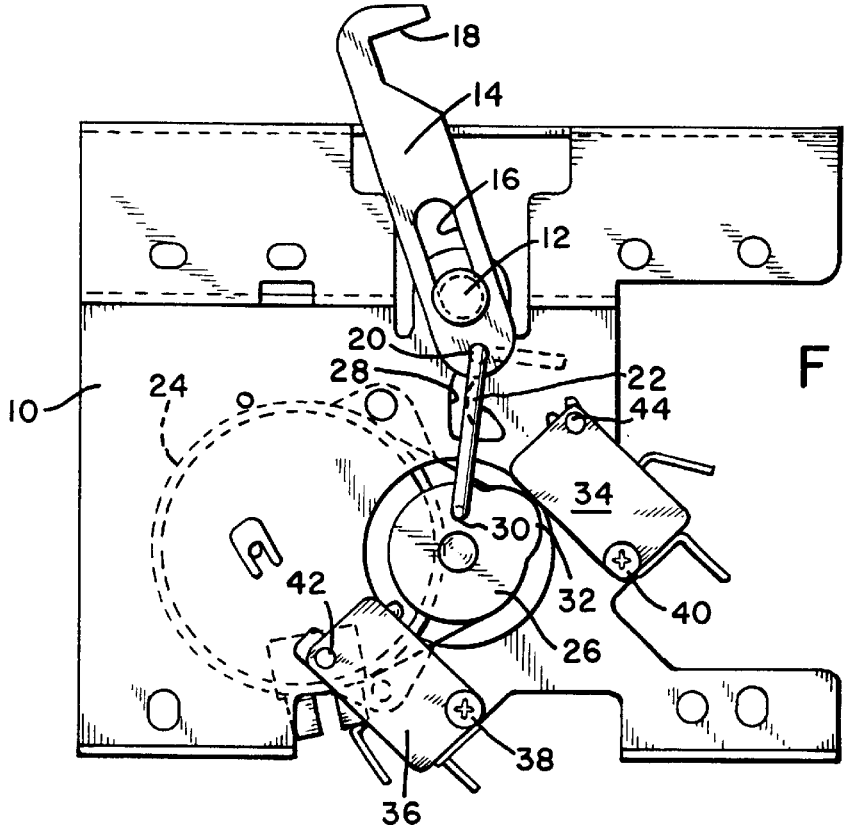
FIG. 1 provides a top plan view of a first embodiment of the present invention showing the oven door latch in the open position.

Referring to FIG. 1, the present invention comprises an oven latch including a base 10, a pivot 12 mounted on the base and a latch arm 14. The latch arm 14 includes a slot 16, a hook 18 at one end for engaging an oven door and an opening 20 at the opposite end for receiving an end of rod 22. Pivot 12, which may be a screw or a rivet, includes a head having a diameter that larger than the width of slot 16 such that the latch arm 14 is free to slide relative to pivot 12 along the length of slot 16 and to pivot or rotate relative to the pivot. The sliding and pivoting motion of the latch arm 14 is controlled by rod 22. More specifically, the sliding and pivoting motion of the latch arm 14 is controlled by how rod 22 moves opening 20 in the end of the latch arm relative to the location of pivot 12.

The motion of rod 22 and opening 20 is controlled in part by the rotation of motor 24, which turns cam 26 and pulls rod 22, and in part by the shape of guide slot 28. One end of rod 22 engages hole 20 in the latch arm and the other end engages hole 30 in cam 26. The rotation of cam 26 moves hole 30 which pulls or pushes rod 22. This push/pull motion substantially controls the sliding motion of the latch arm 14 relative to pivot 12.

The rotation or pivoting action of the latch arm 14 relative to pivot 12 is primarily controlled by the shape of guide slot 28, which is preferably formed in the approximate shape of a "J." The end of rod 22 that projects through hole 20 in the latch arm continues down into guide slot 28, which is formed in the base 10. The guiding action achieved by this design may also be accomplished by using a projection from the latch arm other than the end of rod 22, and the guide slot 28 may be located in a separate piece, other than the base, but the preferred arrangement is as shown.

One end of rod 22 engages hole 20 in the latch arm 14 and the opposite end engages hole 30 in cam 26. As can be seen by comparing the first position of cam 26 in FIG. 1 with the second position of cam 26 in FIG. 2, as the motor 24 is turned on, cam 26 rotates to move hole 30 farther away from pivot 12. As cam 26 rotates, it pulls the rod 22 and the latch arm 14. This causes the latch arm to slide relative to pivot 12 along the length of slot 16. Simultaneously, the latch arm 14 pivots about pivot 12 under the influence of guide slot 28 as it guides the protruding end of rod 22. Because the end of rod 22 extends vertically down through hole 20 and into the guide slot 28, hole 20 always remains above slot 28.

The rotating and sliding motion of the latch arm causes hook 18 to engage the oven door and draw inwards into the closed and locked position. The motor 24 is operated by control circuitry provided by the oven. Although the design preferably uses a guide slot, those with skill in this art may use other methods to control the rotating motion of the latch arm relative to the pivot in combination with the sliding motion produced by the rod 22 and cam 26. Such methods may include springs appropriately positioned or other types of guide surfaces contacting the latch arm or the elements connected to the latch arm.

It can also be seen from the above description that cam 30 does not need a lobe to operate the rod 22 and the latch arm 14. However, in the preferred design, lobe 32 on cam 30 is used to alternately operate microswitches 34 and 36 as the cam turns. Microswitches 34 and 36 are used to signal the position of cam 30 to the oven control. Other optional switches, such as a switch 54 seen in FIG. 3 may be mounted on base 10 to signal when the oven door is closed.

The microswitches 34, 36 are held in position by a single screw for each switch. Screw 38 holds switch 36 and screw 40 holds switch 34. The screws 38 and 40 are threaded into the base 10. A pin projects upward from the base into opening 42 on switch 36 and a corresponding pin projects upwards into opening 44 on switch 34. The projecting pins prevent the switches from rotating about their respective retaining screws 38, 40.

Figure 2:
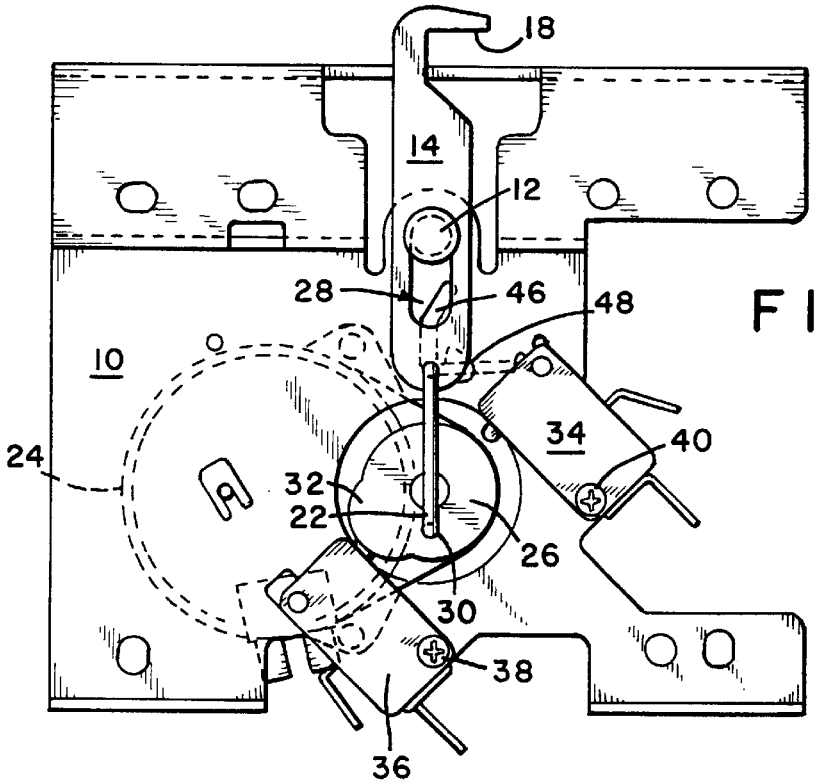
FIG. 2 provides a top plan view of the oven latch seen in FIG. 1 with the latch in the closed position.
Figure 3:
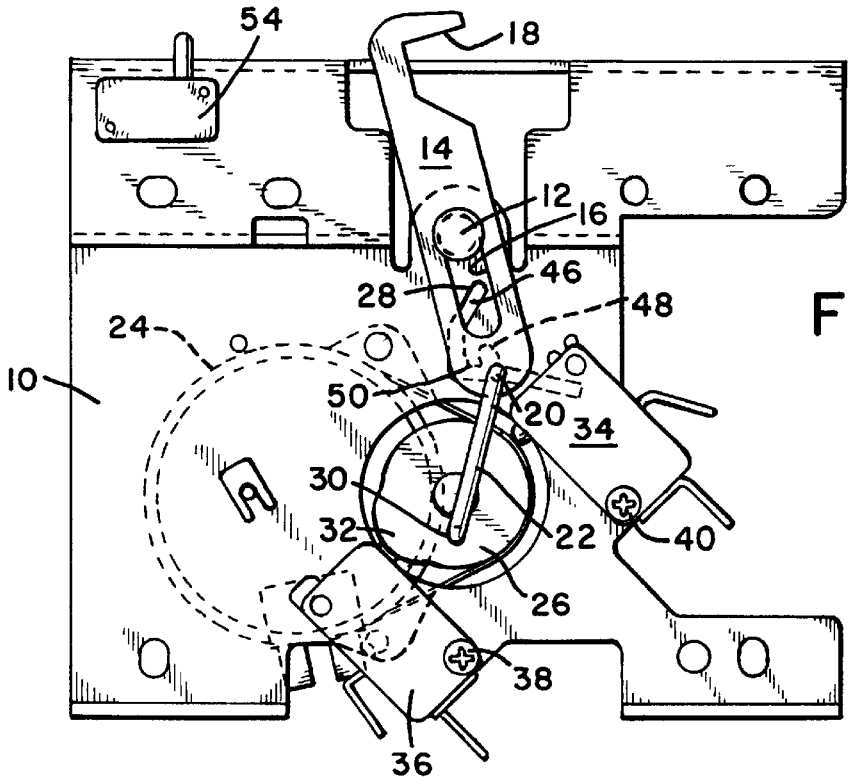
FIG. 3 provides a top plan view of the present invention showing the oven latch with motor and cam in the closed position, but with the latch manipulated by a service tool to the open position to permit the oven door to be opened if the motor fails.

A difficulty with motorized latches occurs when the motor 24 fails while the oven latch is in the closed position seen in FIG. 2. If this happens, the oven door is stuck in the closed position. The present invention provides a method of manipulating the latch when the cam remains in the closed and locked position (seen in FIG. 2) so that the oven door can be opened. FIG. 3 shows how this is achieved.

Referring first to the guide slot 28 in FIGS. 1–2, it can be seen that during normal operation, hole 20 remains above only a first portion of the guide slot 28 which is the normal guide portion 46. The end of rod 22 projecting through hole 20 moves back and forth between the limits of the normal guide portion 46 of slot 28 as the latch opens and closes during a normal oven cleaning cycle.

However, as can be seen in FIG. 3, the guide slot 28 also includes a second portion, referred to as the repair guide portion 48, that can be used during repair to open the latch even when the cam is in the closed position seen in FIG. 2. During normal operation, the rod 22 is prevented from entering the repair guide portion 48 of the guide slot by a mechanical obstruction 50. Obstruction 50 comprises a small piece of bendable metal, formed when the guide slot is constructed, which narrows the slot to a width less than the diameter of rod 22. This narrowing prevents the end of rod 22 from moving from the normal guide portion 46 into the repair guide portion 48.

The mechanical obstruction 50 can be bent sufficiently away from the opposite wall of slot 28 to allow rod 22 to move into the repair guide portion 48 as illustrated in FIG. 3. This motion is achieved with a service tool, or a screw driver, used to bend the mechanical obstruction and manipulate the position of the latch arm and rod 22. The repair guide portion of the guide slot allows the latch arm 14 to pivot sufficiently to open the oven door even though the latch arm cannot slide and even though cam 30 is in the position seen in FIG. 2.

Figure 4:
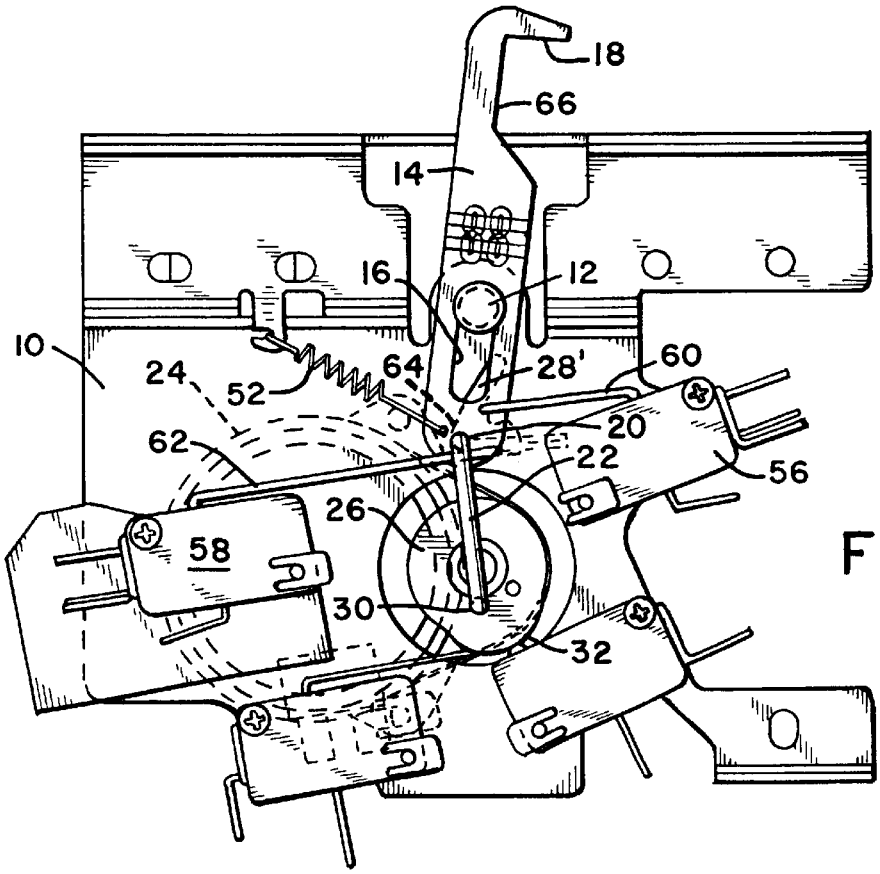
FIG. 4 provides a top plan view of a second embodiment of the present invention having a switch to detect the absence of an oven door showing the oven door latch in the position taken when the oven door is absent.

FIG. 4 shows an alternative design for the self-cleaning oven latch of the present invention in which the mechanical obstruction 50 is eliminated. Repeated bending of the mechanical obstruction 50 could break it, although repeated use is not likely. In the embodiment of the invention seen in FIG. 4, the width of the guide slot is sufficient to allow the rod 22 to freely pass between the normal guide portion and the repair guide portion. To prevent the rod 22 from moving into the repair guide portion during normal operation, a spring 52 is connected between the base 10 and the latch rod 22 to continually urge the latch arm 14 into the normal guide portion of the guide slot 28', which has been widened at the end of the normal guide portion near the motor.

During repair, pressure applied to the latch arm or rod against the spring force can push the rod 22 into the repair guide portion to open the latch. This may be done repeatedly, if necessary, without damaging the mechanism. The spring may alternatively be attached to the latch arm 14 near hole 20.

In addition to the spring 52, the embodiment of FIG. 4 adds a pair of switches 56, 58 having lever arms 60, 62, respectively. Lever arm 60 has a length that is just sufficient to extend partly across the widened end 64 of the normal guide portion of guide slot 28'. The combination of this length for the lever arm 60, the widened end 64 of the guide slot and spring 52 allows switch 56 to sense whether the oven door is actually present and latched closed at the end of the latch cycle.

If the oven door is not present, as shown in FIG. 4, contact point 66 on the latch hook 18 moves to the right, past the normal point of contact limited by the presence of the oven door. This motion allows the spring 52 to pull the end of latch rod 22 to the left side of the widened slot so that it passes the end of lever arm 60 as the cam 26 is rotating to the second (closed) position shown in FIG. 4. Thus, if the oven door is not present at the end of the locking cycle, switch 56 will not be actuated. Switch 58 is optional, and will be actuated whenever cam 26 is in the second position, as shown. The normal guide portion of guide slot 28 may be straight or it may have a bend.

Figure 5:
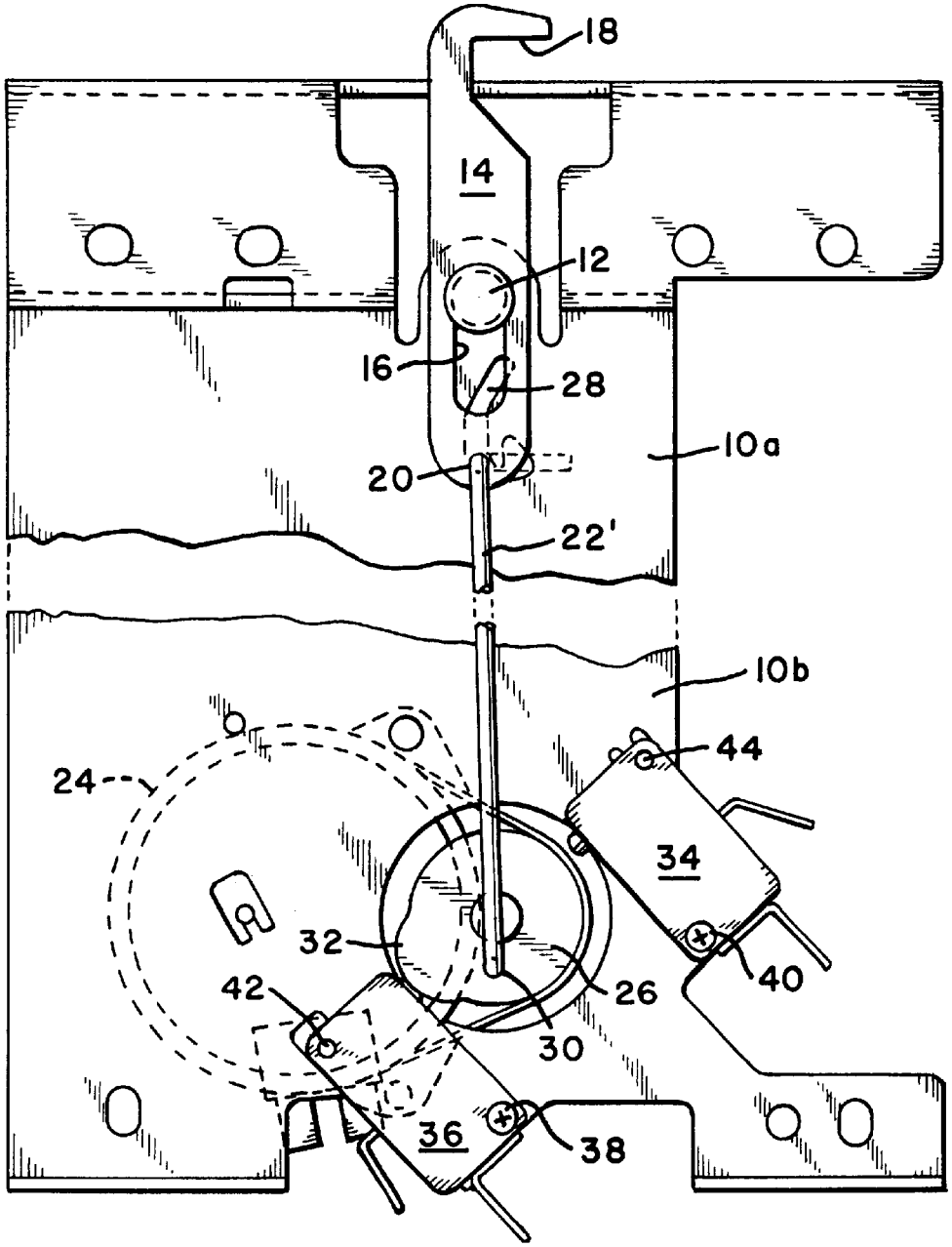
FIG. 5 provides a top plan view of a third embodiment of the present invention showing the oven door latch in the open position.

FIG. 5 shows a third embodiment of the present invention. In this design, the base is split into two halves. A front portion of the base 10*a* is mounted near the door and includes the latch arm, guide slot and pivot. These pieces are relatively insensitive to heat, which may be higher near the door. The motor, cam and switches, which tend to be more heat sensitive than the remaining components, are separated from the latch arm, guide slot and pivot and are mounted on a back portion of the base 10*b*. The front and back portions 10*a*, 10*b* may be part of a single extended piece, or they may be separate pieces.

This design permits the most heat sensitive components to be mounted in a different location where they may be more easily protected. Portions 10*a* and 10*b* may be separated by any desired distance, and a lengthened rod 22' having the necessary length is used to connect them.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An oven latch comprising:

a base;

a pivot mounted on the base;

a latch arm having a slot formed therein, the slot engaging the pivot and the latch arm sliding and rotating relative to the pivot;

a motor;

a cam rotatably driven by the motor from a first position to a second position; and a rod connected to the cam and the latch arm, the rod sliding and rotating the latch arm from an open position to a closed position as the cam rotates from the first position to the second position.

2. The oven latch of claim 1 further including a guide slot, an end of the latch arm being guided by the guide slot to control sliding and rotating motion of the latch arm relative to the pivot.

3. The oven latch of claim 2 wherein the rod includes first and second rod ends, the first rod end engages the latch arm and the guide slot to guide the end of the latch arm along the guide slot and control motion of the latch arm relative to the pivot, and the second rod end is connected to the cam.

4. The oven latch of claim 2 wherein the guide slot has a normal guide portion and a repair guide portion, the end of the latch arm being guided by the normal guide portion of the guide slot during normal operation as the latch arm is moved by the cam and rod between the open position with the cam in the first position and the closed position with the cam in the second position, and the end of the latch arm being guided by the repair guide portion of the guide slot during repair of the oven latch to permit the oven latch to be opened when the cam is in the second position.

5. The oven latch of claim 4 wherein the guide slot is shaped as a J slot, a first portion of the J-slot comprising the normal guide portion and a second portion of the J-slot forming the repair guide portion.

6. The oven latch of claim 4 wherein the guide slot has a mechanical obstruction to limit motion of the end of the latch arm to motion along the normal guide portion of the guide slot during normal operation.

7. The oven latch of claim 6 wherein the mechanical obstruction is bendable to permit the end of the latch arm to be guided between the normal guide portion of the guide slot and the repair guide portion of the guide slot.

8. The oven latch of claim 4 further including a spring connected to keep the end of the latch arm guided by the normal guide portion of the guide slot during normal operation of the oven latch, the spring allowing the end of the latch arm and the rod to be manipulated and guided by the repair guide portion of the guide slot during repair of the oven latch to permit the oven latch to be opened when the cam is in the second position.

9. The oven latch of claim 1 further including at least one switch operated by the cam, the switch moving between open and closed as the cam rotates.

10. The oven latch of claim 1 wherein the base includes first and second halves, the first half being mountable near a door of an oven to be latched and the latch arm and the pivot mounted thereon, the second half of the base having the motor and cam mounted thereon and being mountable in a remote location, the rod operably extending between the first and second halves of the base.

11. The oven latch of claim 1 further including:

a guide slot having a widened portion; and an oven door sensing switch having an actuator extending partially across the widened portion of the guide slot;

an end of the latch arm being guided by the guide slot to control sliding and rotating motion of the latch arm relative to the pivot, and the oven door sensing switch detecting when the end of the latch arm is guided by the widened portion of the guide slot to detect the absence of an oven door.

12. The oven latch of claim 11 wherein the rod includes first and second rod ends, the first rod end engages the latch arm and the guide slot to guide the end of the latch arm along the guide slot and control motion of the latch arm relative to the pivot, and the second rod end is connected to the cam, the first rod end entering the widened portion of the guide slot and actuating the oven door sensing switch to detect the absence of an oven door.

13. An oven latch comprising:

a base;

a pivot mounted on the base;

a latch arm having a slot formed therein, the slot engaging the pivot and the latch arm sliding and rotating relative to the pivot;

a motor mounted on the base;

a cam rotatably driven by the motor from a first position to a second position;

a guide slot formed in the base having a normal guide portion and a repair guide portion; and a rod connected between the cam and an end of the latch arm, an end of the rod engaging the end of the latch arm and extending into the guide slot, the rod sliding and rotating the latch arm from an open position to a closed position as the cam rotates from the first position to the second position and the rod ends moves within the normal guide portion of the guide slot, the rod being moveable into the repair guide portion of the guide slot when the cam is in the second position to permit the oven latch to be opened when the cam is in the second position.

14. The oven latch of claim 13 wherein the guide slot is shaped as a J-slot, a first portion of the J-slot comprising the normal guide portion and a second portion of the J-slot forming the repair guide portion.

15. The oven latch of claim 14 wherein the J-slot has a mechanical obstruction to limit motion of the end of the rod to motion along the normal guide portion of the J-slot during normal operation.

16. The oven latch of claim 15 wherein the mechanical obstruction is bendable to permit the end of the rod to move between the normal guide portion of the guide slot and the repair guide portion of the guide slot.

17. The oven latch of claim 13 further including a spring connected between the base and the rod, the spring keeping the end of the rod in the normal guide portion of the guide slot during normal operation of the oven latch, the spring allowing the end of the rod to be manipulated into the repair guide portion of the guide slot during repair of the oven latch to permit the oven latch to be opened when the cam is in the second position.

18. The oven latch of claim 13 further including at least one switch operated by the cam, the switch moving between open and closed positions as the cam rotates.

19. The oven latch of claim 13 wherein the at least one switch is mounted to the base with a single screw.

20. The oven latch of claim 18 wherein the cam includes a lobe for operating the at least one switch and an opening for receiving an opposite end of the rod from the end of the rod engaging the latch arm.

21. The oven latch of claim 13 further including a plurality of switches operated by the cam, the switches moving between open and closed positions as the cam rotates.

22. The oven latch of claim 13 further including a door switch mounted on the base, the door switch moving between open and closed positions to signal the presence or absence of a door in position to be latched by the latch arm.

* * * * *